US010205222B2

(12) United States Patent
Chen et al.

(10) Patent No.: US 10,205,222 B2
(45) Date of Patent: Feb. 12, 2019

(54) ELECTRONIC MODULE

(71) Applicant: UNIVERSAL SCIENTIFIC INDUSTRIAL (SHANGHAI) CO., LTD., Shanghai (CN)

(72) Inventors: Hsin-Hong Chen, Shanghai (CN); Jui-Kun Shih, Shanghai (CN); Chun-Huang Li, Shanghai (CN)

(73) Assignee: UNIVERSAL SCIENTIFIC INDUSTRIAL (SHANGHAI) CO., LTD., Shanghai (CN)

( * ) Notice: Subject to any disclaimer, the term of this patent is extended or adjusted under 35 U.S.C. 154(b) by 156 days.

(21) Appl. No.: 15/243,762

(22) Filed: Aug. 22, 2016

(65) Prior Publication Data

US 2018/0026342 A1 Jan. 25, 2018

(30) Foreign Application Priority Data

Jul. 21, 2016 (CN) ..... 2016 1 0578139

(51) Int. Cl.

| | |
|---|---|
| ***H01Q 1/22*** | (2006.01) |
| ***H01Q 1/48*** | (2006.01) |
| ***H01Q 1/24*** | (2006.01) |
| ***H01Q 21/00*** | (2006.01) |
| ***H01Q 1/36*** | (2006.01) |

(52) U.S. Cl.

CPC ..... *H01Q 1/243* (2013.01); *H01Q 1/2283* (2013.01); *H01Q 1/36* (2013.01); *H01Q 1/48* (2013.01); *H01Q 21/00* (2013.01); *H01Q 21/0025* (2013.01)

(58) Field of Classification Search

CPC ..... H01Q 1/2283; H01Q 1/38; H01Q 1/243; H01Q 1/48; H01Q 21/00

See application file for complete search history.

(56) References Cited

U.S. PATENT DOCUMENTS

| | | | | |
|---|---|---|---|---|
| 7,696,930 | B2 * | 4/2010 | Akkermans | G06K 19/07749 343/700 MS |
| 7,821,471 | B2 * | 10/2010 | Yoshioka | H01Q 1/38 343/700 MS |
| 9,806,422 | B2 * | 10/2017 | Garcia | H01Q 21/28 |
| 2009/0184882 | A1 * | 7/2009 | Jow | H01L 23/3121 343/873 |
| 2015/0070228 | A1 * | 3/2015 | Gu | H01Q 1/2283 343/727 |

* cited by examiner

*Primary Examiner* — Tho G Phan
*Assistant Examiner* — Patrick R Holecek
(74) *Attorney, Agent, or Firm* — Foley & Lardner LLP; Cliff Z. Liu

(57) ABSTRACT

The present disclosure provides an electronic module. The electronic module comprises an IC, a substrate and an antenna. The substrate has a top surface, a bottom surface and a lateral surface. The IC is electrically connected to the bottom surface. The antenna is disposed on at least two of the top surface, the bottom surface and the lateral surface.

17 Claims, 4 Drawing Sheets

ELECTRONIC MODULE

CROSS-REFERENCE TO RELATED PATENT APPLICATIONS

This application claims the benefit of and priority to Chinese Patent Application Number 201610578139.3 filed on Jul. 21, 2016, the contents of which are incorporated herein by reference in their entirety.

BACKGROUND

1. Technical Field

The present disclosure relates to an electronic module, and more particularly, to an electronic module having an antenna.

2. Description of the Related Art

The conventional wireless communication device comprises an antenna module and an integrated circuit (IC). The antenna module and the IC are disposed on a same plane, which would result in that the wireless communication device occupies a larger area. With respect to another conventional wireless communication device, a molding process would apply on the IC and then an antenna is mounted on the molded IC. However, in this manufacturing process, a molding process should be applied on the IC, which would increase the manufacturing cost of the wireless communication device.

SUMMARY

The present disclose provides an electronic module with the lower manufacturing cost to solve the above-mentioned problem.

In accordance with a first embodiment of the present disclosure, an electronic module is provided. The electronic module comprises an IC, a substrate and an antenna. The substrate has a top surface, a bottom surface and a lateral surface. The IC is electrically connected to the bottom surface. The antenna is disposed on at least two of the top surface, the bottom surface and the lateral surface.

In accordance with a second embodiment of the present disclosure, an electronic module is provided. The electronic module comprises an IC, a substrate, a first antenna array, a second antenna array and a third antenna array. The substrate has a top surface, a bottom surface and a lateral surface. The IC is electrically connected to the bottom surface. The first antenna array is disposed on the top surface. The second antenna array is disposed on the lateral surface. The third antenna array is disposed on the bottom surface.

In accordance with a third embodiment of the present disclosure, an electronic module is provided. The electronic module comprises an IC, a substrate, an antenna and a frame board. The substrate has a top surface, a bottom surface and a lateral surface. The IC is electrically connected to the bottom surface. The antenna is disposed on at least two of the top surface, the bottom surface and the lateral surface. The frame board is disposed on the bottom surface for mounting the substrate on a circuit board.

In addition to the small area of the above electronic module, there is no need to perform a molding process on the electronic module. Therefore, the embodiments of the present disclosure can drastically reduce the cost of manufacturing the electronic module. In addition, since the antenna of the present disclosure can be disposed on the surfaces in different directions, it is easier to design antennas with different polarizations. Furthermore, the antenna of the present disclosure has a larger design area and a better radiation environment. Therefore, the antenna of the present disclosure provides a better performance on throughput in comparison with the conventional antenna.

The technical features and advantages of the present disclosure are comprehensively summarized above, so that the following detailed descriptions could be easily understood. While the present disclosure has been described and illustrated with reference to specific embodiments thereof, these descriptions and illustrations do not limit the present disclosure. It can be clearly understood by those skilled in the art that various changes may be made, and equivalent elements may be substituted within the embodiments without departing from the true spirit and scope of the present disclosure as defined by the appended claims. Modifications may be made to adapt a particular situation, material, composition of matter, method, or process to the objective, spirit and scope of the present disclosure. All such modifications are intended to be within the scope of the claims appended hereto.

BRIEF DESCRIPTION OF THE DRAWINGS

Common reference numerals are used throughout the drawings and the detailed description to indicate the same or similar components. The present disclosure will be more apparent from the following detailed description taken in conjunction with the accompanying drawings. It should be noticed that the elements in the drawings may not necessarily be drawn to scale. For clear discussion, the scale of each element may be enlarged or shrunk.

DETAILED DESCRIPTION

While the present disclosure has been described and illustrated with reference to specific embodiments thereof, these descriptions and illustrations do not limit the present disclosure. It can be clearly understood by those skilled in the art that various changes may be made, and equivalent elements may be substituted within the embodiments without departing from the true spirit and scope of the present disclosure as defined by the appended claims. Modifications may be made to adapt a particular situation, material, composition of matter, method, or process to the objective, spirit and scope of the present disclosure. All such modifications are intended to be within the scope of the claims appended hereto.

Figure 1:
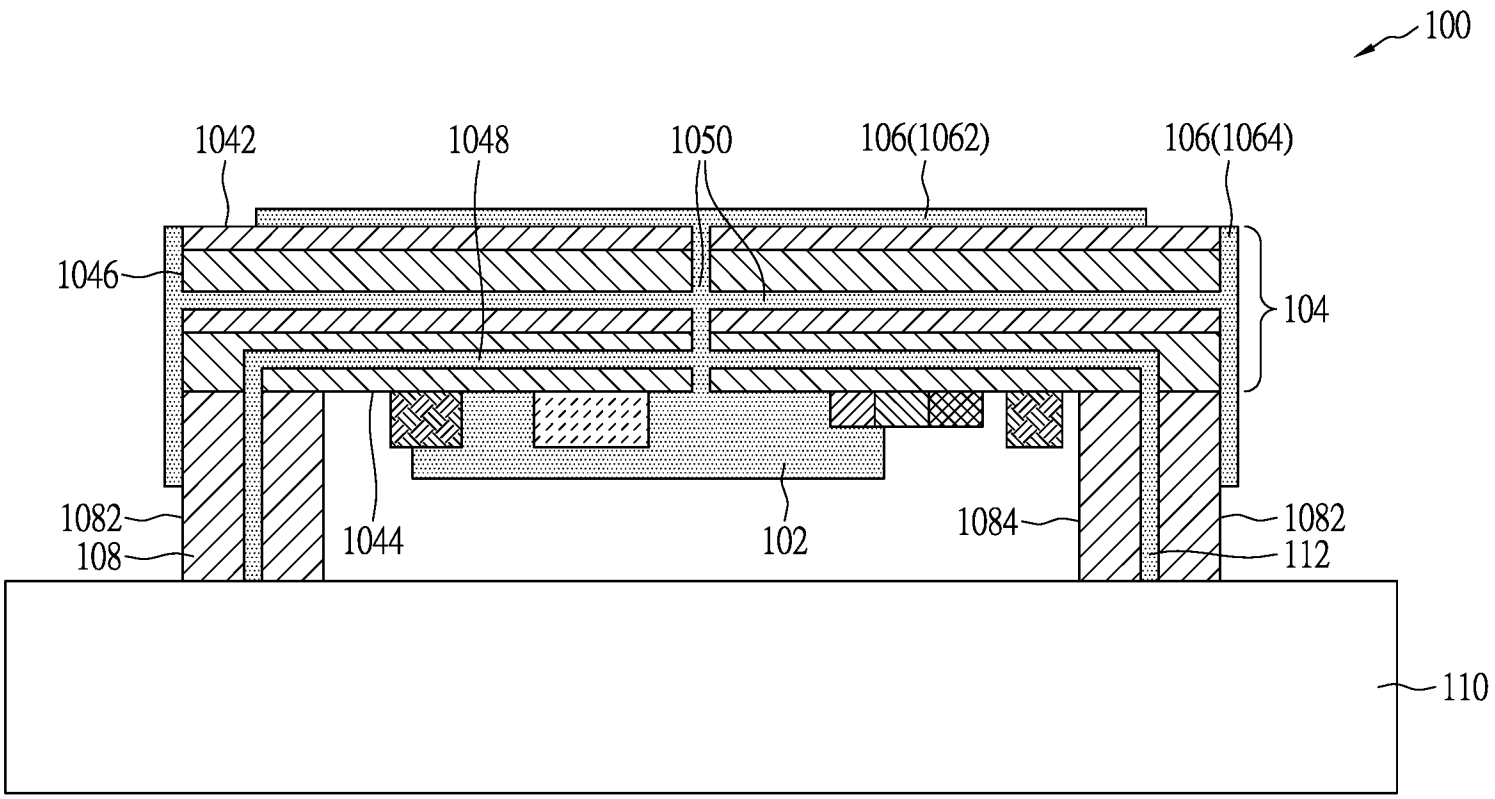
FIG. 1 illustrates a cross-sectional view of an electronic module in accordance with a first embodiment of the present disclosure.

FIG. 1 illustrates a cross-sectional view of an electronic module 100 in accordance with a first embodiment of the present disclosure. The electronic module 100 comprises an IC 102, a substrate 104, an antenna 106 and a frame board 108. In accordance with the embodiment of the present disclosure, the electronic module 100 is regarded as a system in package (SiP) module. The substrate 104 has a top surface 1042, a bottom surface 1044 and a lateral surface 1046. The IC 102 is electrically connected to the bottom surface 1044. The frame board 108 is a ring frame having an exterior surface 1082 and an interior surface 1084. The frame board 108 is disposed on the bottom surface 1044 for electrically connecting the IC 102 and the substrate 104 to a circuit board 110. As shown in FIG. 1, the antenna 106 is disposed on at least two surfaces of the top surface 1042, the bottom surface 1044 and the lateral surface 1046. In the embodiment, the antenna 106 is disposed on the top surface 1042 of the substrate 104, the lateral surface 1046 of the substrate 104 and the exterior surface 1082 of the frame board. In addition, in the embodiment, since the exterior surface 1082 of the frame board 108 and the lateral surface 1046 of the substrate 104 substantially form a plane, the antenna 106 is continuously disposed on the plane formed by the exterior surface 1082 and the lateral surface 1046. However, this is not a limitation of the present disclosure. In another embodiment, the antenna 106 is disposed on the top surface 1042 and the lateral surface 1046 of the substrate 104, but does not extend to the exterior surface 1082 of the frame board 108.

In accordance with an embodiment of the present disclosure, the substrate 104 is a structure with multiple insulating layers, wherein a metal layer is disposed between two adjacent insulating layers. The pattern of the metal layer can be designed based on requirements. In the embodiment, the substrate 104 at least comprises a feeding line 1050 and a grounding layer 1048. The feeding line 1050 is used to feed the signal outputted by the IC 102 into the antenna 106. Therefore, the feeding line 1050 is electrically connected to the IC 102. However, it is unnecessary to electrically connect the feeding line 1050 to the antenna 106. In an embodiment, the feeding line 1050 is directly electrically connected to the antenna 106. In another embodiment, the feeding line 1050 is coupled with the antenna 106 but not directly connected to the antenna 106.

The grounding layer 1048 is disposed in the metal layer that is closer to the IC 102, so as to block the signal of the antenna 106 from entering the IC 102. However, the grounding layer 1048 is not directly connected to the antenna 106. The grounding layer 1048 is electrically connected to a grounding plane 112 in the frame board 108 through a conductor, such as a solder. When the frame board 108 is disposed on the circuit board 110, the grounding plane 112 is electrically connected to a grounding layer in the circuit board 110. Please be noticed that in another embodiment of the present disclosure, the grounding plane 112 may be multiple grounding lines, which has similar characteristics to the grounding plane 112.

In comparison with the conventional wireless communication device, the antenna 106 of the embodiment of the present disclosure is directly disposed on the top and sidewall of the IC 102 rather than on a same plane where the IC 102 is disposed. Therefore, the electronic module 100 of the embodiment would occupy a smaller area. In addition, the electronic module 100 of the embodiment forms a signal block device by utilizing the grounding layer 1048 in the substrate 104 and the grounding plane 112 in the frame board 108, so as to reduce the effect of the signal of the antenna 106 on the signal in the IC 102. Unlike the conventional wireless communication device, there is no molding process on the IC 102 of the electronic module 100. In other words, the molding process on the IC 102 is omitted when manufacturing the electronic module 100 of the embodiment. Therefore, the embodiments of the present disclosure can drastically reduce the cost of manufacturing the electronic module 100.

In addition, the antenna 106 can be disposed on the plane formed by the exterior surface 1082 and the lateral surface 1046 in addition to the top surface 1042 of the substrate 104. Therefore, it is easier to design the antenna 106 of the embodiment as an antenna with different polarizations. Furthermore, the antenna 106 of the embodiment has a larger design area and a better radiation environment. Therefore, the antenna 106 of the embodiment has higher efficiency in comparison with the conventional antenna. For example, when the electronic module 100 of the embodiment is applied in a wireless local network complying with IEEE 802.11ad, the electronic module 100 provides a better performance on throughput.

Please be noticed that in the electronic module 100 of the first embodiment, the antenna 106 comprises two separated antenna arrays, i.e., a first antenna array 1062 and a second antenna array 1064 disposed on the top surface 1042, the lateral surface 1046 and the exterior surface 1082 accordingly. However, this is not a limitation of the present disclosure. In another embodiment, the first antenna array 1062 and the second antenna array 1064 can be combined into an antenna array.

Figure 2:
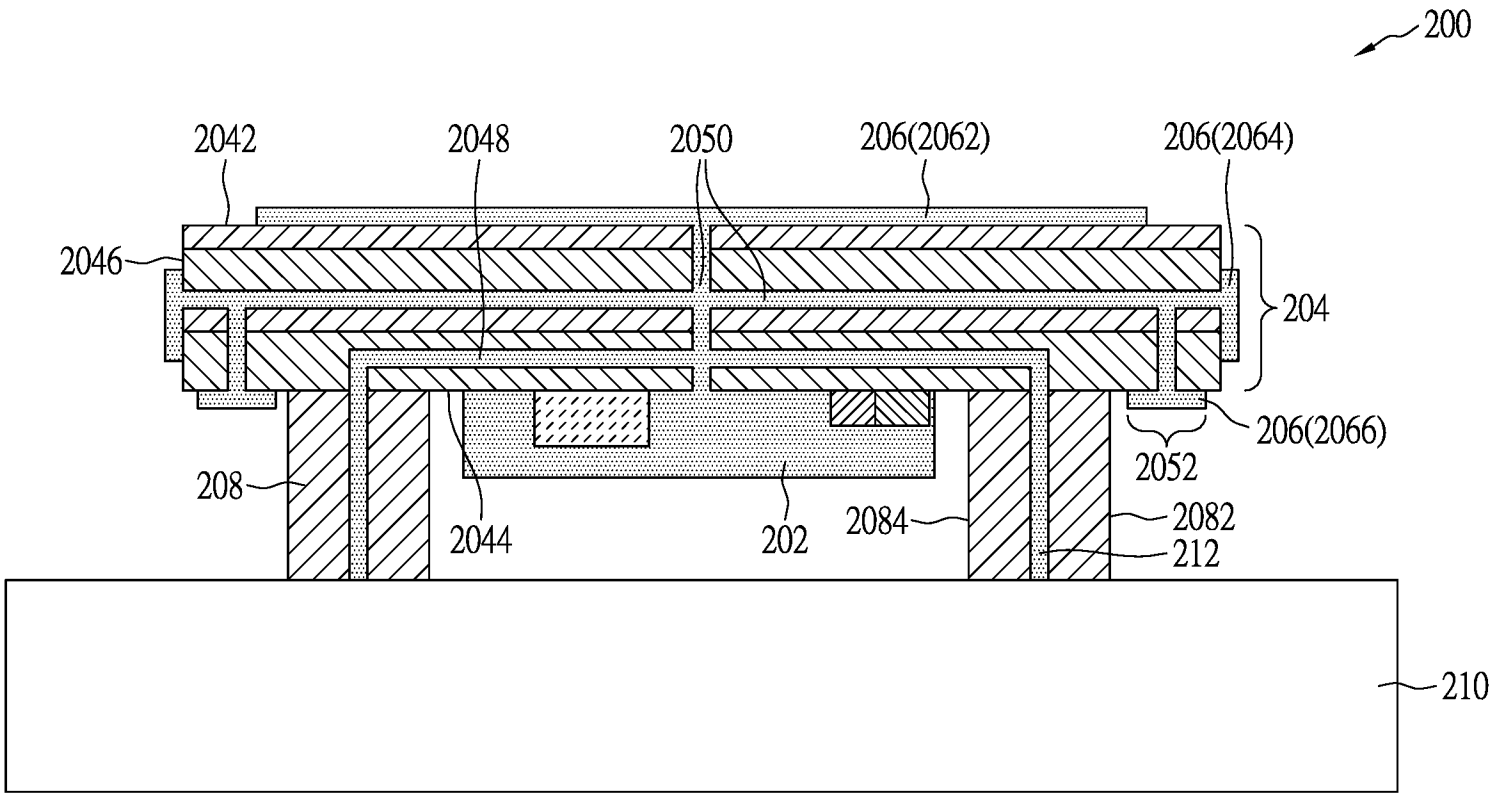
FIG. 2 illustrates a cross-sectional view of an electronic module in accordance with a second embodiment of the present disclosure.

In the electronic module 100 of FIG. 1, because the frame board 108 and the substrate 104 have the same outline and perimeter, the exterior surface 1082 of the frame board 108 and the lateral surface 1046 of the substrate 104 form the plane when the frame board 108 is disposed on the substrate 104. Therefore, the antenna 106 extends from the lateral surface 1046 of the substrate 104 to the exterior surface 1082 of the frame board 108. However, this is not a limitation of the present disclosure. In another embodiment, the frame board 108 and the substrate 104 have different perimeters (as shown in FIG. 2). FIG. 2 illustrates an electronic module 200 in accordance with a second embodiment of the present disclosure. The electronic module 200 comprises an IC 202, a substrate 204, an antenna 206 and a frame board 208. The substrate 204 has a top surface 2042, a bottom surface 2044 and a lateral surface 2046. The IC 202 is electrically connected to the bottom surface 2044. The frame board 208 is a ring frame having an exterior surface 2082 and an interior surface 2084. The frame board 208 is disposed on the bottom surface 2044 for electrically connecting the IC 202 and the substrate 204 to a circuit board 210. As shown in FIG. 2, the perimeter of the exterior surface 2082 of the frame board 208 is less than that of the lateral surface 2046 of the substrate 204. Therefore, when the frame board is disposed on the bottom surface 2044 of the substrate 204, the outer portion of the bottom surface 2052 is located at the outer side of the frame board 208 and suspended above the circuit board 210. In other words, the exterior surface 2082 of the frame board 208 and the lateral surface 2046 of the substrate 204 are not coplanar. In the embodiment, the antenna 206 comprises a first antenna array 2062, a second antenna array 2064 and a third antenna array 2066, which are respectively disposed on the top surface 2042 of the substrate 204, the lateral surface 2046 of the substrate 204 and the outer portion of the bottom surface 2052.

In accordance with an embodiment of the present disclosure, the substrate 204 at least comprises a feeding line 2050 and a grounding layer 2048. The feeding line 2050 is used to feed the signal outputted by the IC 202 into the antenna 206. Therefore, the feeding line 2050 is electrically connected to the IC 202. However, it is unnecessary to electrically connect the feeding line 2050 to the antenna 206.

The grounding layer 2048 is disposed in the metal layer that is closer to the IC 202, so as to block the signal of the antenna 206 from entering the IC 202. However, the grounding layer 2048 is not directly connected to the antenna 206. The grounding layer 2048 is electrically connected to a grounding plane 212 in the frame board 208 through a conductor, such as a solder. When the frame board 208 is disposed on the circuit board 210, the grounding plane 212 is electrically connected to a grounding layer in the circuit board 210. In another embodiment of the present disclosure, the grounding plane 212 may be multiple grounding lines, which has similar characteristics to the grounding plane 212.

Similar to the electronic module 100 of the first embodiment, the antenna 206 of the electronic module 200 of the embodiment is directly disposed on the IC 202 and the electronic module 200 of the embodiment forms a signal block device by utilizing the grounding layer 2048 in the substrate 204 and the grounding plane 212 in the frame board 208. Therefore, the cost of manufacturing the electronic module 200 of the embodiment is much less than that of manufacturing the conventional wireless communication device. Furthermore, because the antenna 206 of the embodiment has a larger design area, a better radiation environment and can be easily designed as an antenna with different polarizations, the antenna 206 of the embodiment has higher efficiency in comparison with the conventional antenna.

Figure 3:
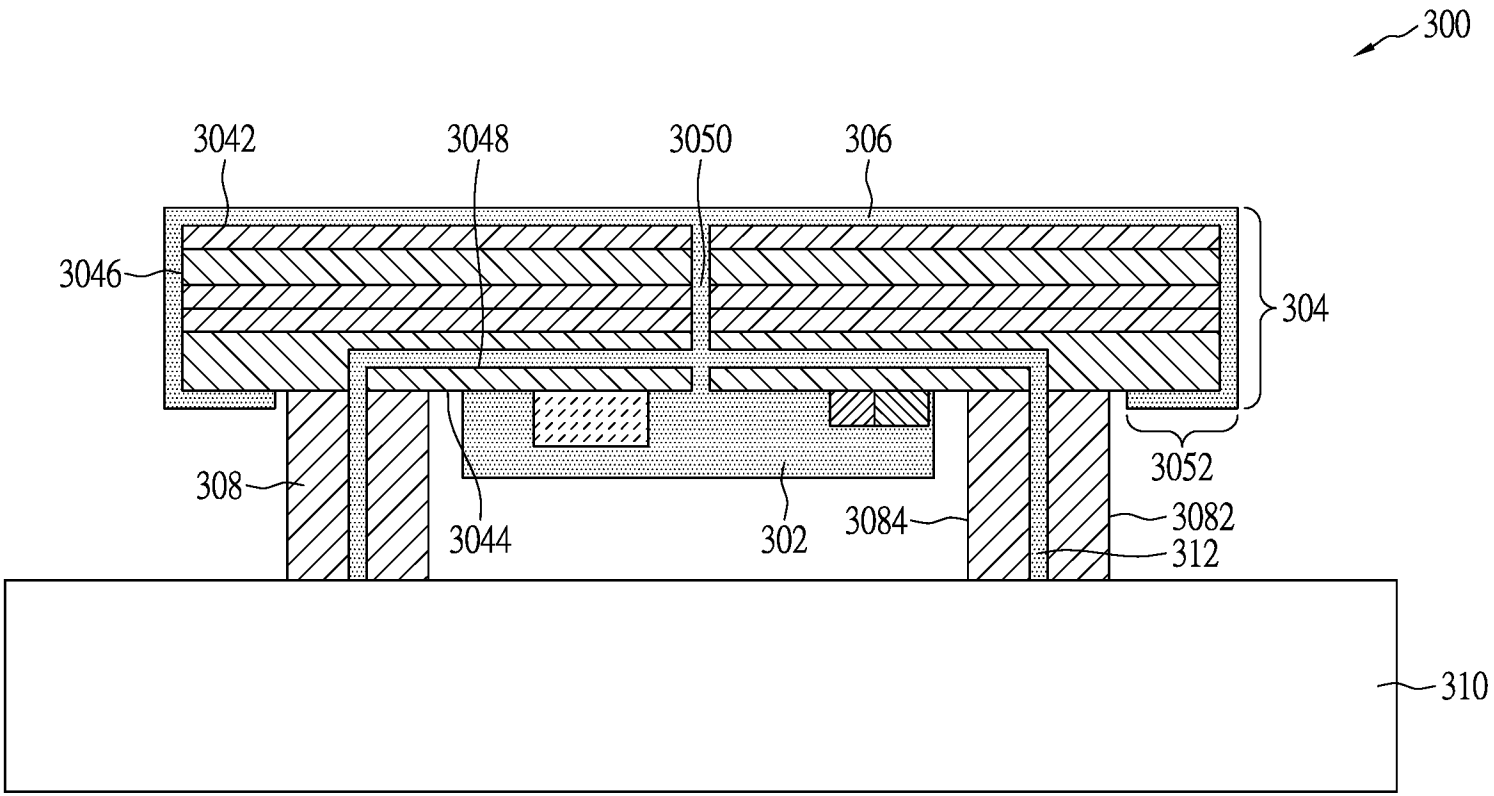
FIG. 3 illustrates a cross-sectional view of an electronic module in accordance with a third embodiment of the present disclosure.

In the electronic module 200 shown in FIG. 2, the first antenna array 2062 on the top surface 2042, the second antenna array 2064 on the lateral surface 2046 and the third antenna array 2066 on the bottom surface 2052 are separated antenna arrays. In other words, the first antenna array 2062, the second antenna array 2064 and the third antenna array 2066 can be regarded as individual antenna arrays. These antenna arrays can be used to transmit or receive signal in a higher frequency band (e.g., 60 GHz). However, this is not an limitation of the present disclosure. In another embodiment as shown in FIG. 3, the first antenna array 2062 on the top surface 2042, the second antenna array 2064 on the lateral surface 2046 and the third antenna array 2066 on the bottom surface 2052 are combined to a single antenna array to transmit or receive signal in a lower frequency band (e.g., 2.4 GHz). FIG. 3 illustrates an electronic module 300 in accordance with a third embodiment of the present disclosure. The electronic module 300 comprises an IC 302, a substrate 304, an antenna 306 and a frame board 308. The substrate 304 has a top surface 3042, a bottom surface 3044 and a lateral surface 3046. The IC 302 is electrically connected to the bottom surface 3044. The frame board 308 is a ring frame having an exterior surface 3082 and an interior surface 3084. The frame board 308 is disposed on the bottom surface 3044 for electrically connecting the IC 302 and the substrate 304 to a circuit board 310. As shown in FIG. 3, the perimeter of the exterior surface 3082 of the frame board 308 is less than that of the lateral surface 3046 of the substrate 304. Therefore, when the frame board 308 is disposed on the bottom surface 3044 of the substrate 304, the outer portion of the bottom surface 3052 is located at the outer side of the frame board 308 and suspended above the circuit board 310. In other words, the exterior surface 3082 of the frame board 308 and the lateral surface 3046 of the substrate 304 are not coplanar. In the embodiment, the antenna 306 is a combined single antenna array disposed on the top surface 3042 of the substrate 304, the lateral surface 3046 of the substrate 304 and the outer portion of the bottom surface 3052.

In accordance with an embodiment of the present disclosure, the substrate 304 at least comprises a feeding line 3050 and a grounding layer 3048. The feeding line 3050 is used to feed the signal outputted by the IC 302 into the antenna 306. Therefore, the feeding line 3050 is electrically connected to the IC 302. However, it is unnecessary to electrically connect the feeding line 3050 to the antenna 306.

The grounding layer 3048 is disposed in the metal layer that is closer to the IC 302, so as to block the signal of the antenna 306 from entering the IC 302. However, the grounding layer 3048 is not directly connected to the antenna 306. The grounding layer 3048 is electrically connected to a grounding plane 312 in the frame board 308 through a conductor, such as a solder. When the frame board 308 is disposed on the circuit board 310, the grounding plane 312 is electrically connected to a grounding layer in the circuit board 310. In another embodiment of the present disclosure, the grounding plane 312 may be multiple grounding lines, which has similar characteristics to the grounding plane 312.

Similar to the electronic module 100 of the first embodiment, the antenna 306 of the electronic module 300 of the embodiment is directly disposed on the IC 302 and the electronic module 300 of the embodiment forms a signal block device by utilizing the grounding layer 3048 in the substrate 304 and the grounding plane 312 in the frame board 308. Therefore, the cost of manufacturing the electronic module 300 of the embodiment is much less than that of manufacturing the conventional wireless communication device. Furthermore, because the antenna 306 of the embodiment has a larger design area, a better radiation environment and can be easily designed as an antenna with different polarizations, the antenna 306 of the embodiment has higher efficiency in comparison with the conventional antenna.

According to FIGS. 2 and 3, it is understood that when the antennas on the top surface, the bottom surface and the lateral surface are separated to form individual antenna arrays, the antennas are used to transmit and receive signal in a first frequency band; and when the antennas on the top surface, the bottom surface and the lateral surface are connected with each other to form a single antenna array, the antennas are used to transmit and receive signal in a second frequency band. The first frequency band is higher than the second frequency band. For example, the first frequency band is 60 GHz and the second frequency band is 2.4 GHz.

Figure 4:
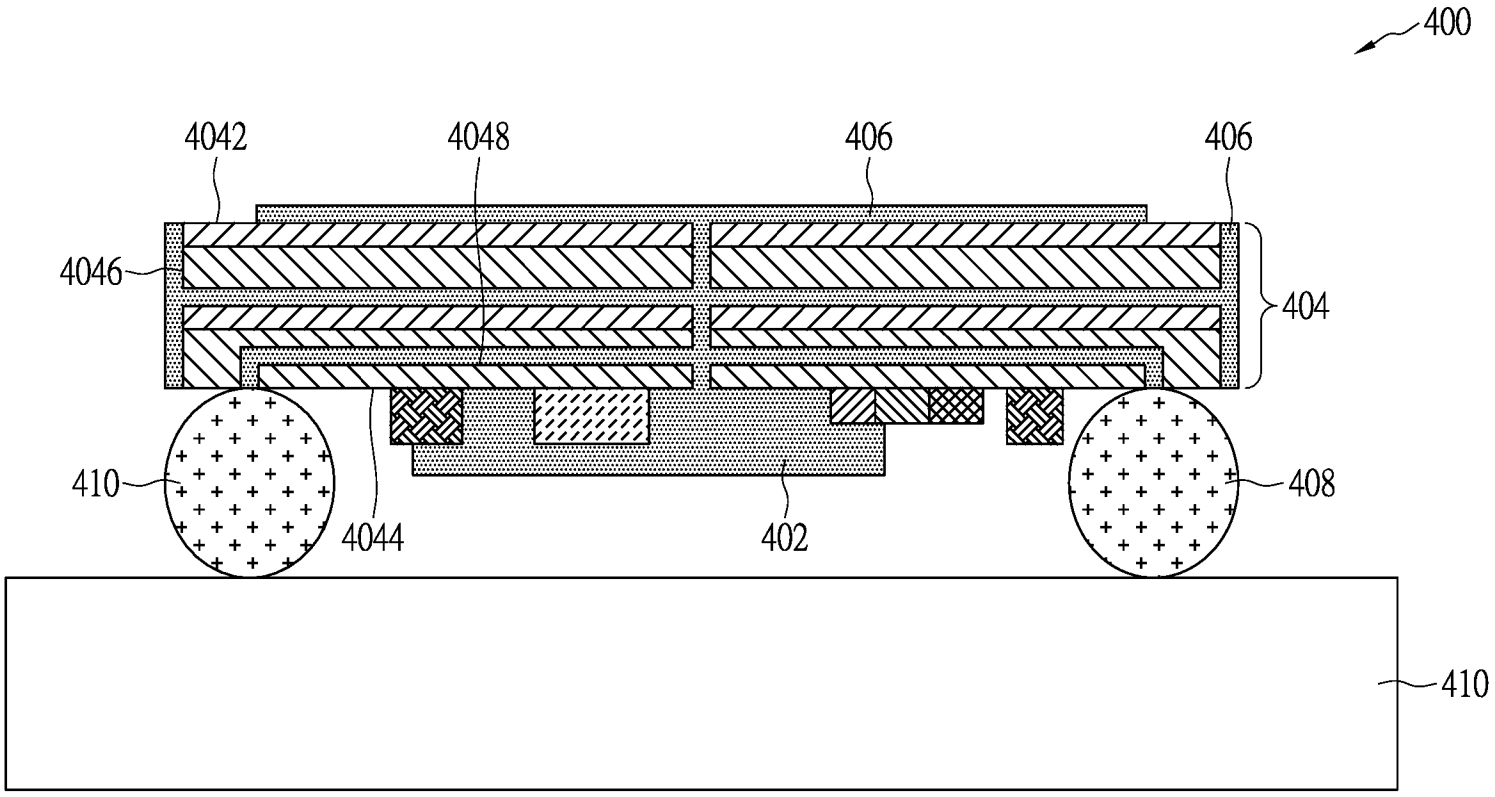
FIG. 4 illustrates a cross-sectional view of an electronic module in accordance with a fourth embodiment of the present disclosure.

In addition, in the embodiment of FIG. 1, the IC and the substrate are mounted on a circuit board by a frame board, so that the antenna can be disposed on the top surface and the lateral surface of the substrate. However, this is not a limitation of the present disclosure. In another embodiment, the IC and the substrate can be mounted on a circuit board through a solder ball (as shown in FIG. 4). FIG. 4 illustrates an electronic module 400 in accordance with a fourth embodiment of the present disclosure. The electronic module 400 comprises an IC 402, a substrate 404, an antenna 406 and a plurality of solder balls 408, 410. The substrate 404 has a top surface 4042, a bottom surface 4044 and a lateral surface 4046. The IC 402 is electrically connected to the bottom surface 4044. The plurality of solder balls 408, 410 are disposed on the bottom surface 4044 for mounting the IC 402 and the substrate 404 on a circuit board 410. In the embodiment, the antenna 406 is disposed on the top surface 4042 and the lateral surface 4046 of the substrate 404. The antenna 406 is isolated from surfaces of the plurality of solder balls 408, 410.

The structure of the substrate 404 in FIG. 4 is similar to that of the substrate 104 of the first embodiment. In the embodiment, the grounding layer 4048 is electrically connected to the solder balls 408, 410. Since the solder balls 408, 410 are formed of conductive materials (such as Sn), the solder balls 408, 410 can electrically connect the grounding layer 4048 to a grounding layer in the circuit board 410.

Similar to the electronic module 100 of the first embodiment, the antenna 406 of the electronic module 400 of the embodiment is directly disposed above the IC 402 and the electronic module 400 of the embodiment forms a signal block device by utilizing the grounding layer 4048 in the substrate 404. Therefore, the cost of manufacturing the electronic module 400 of the embodiment is much less than that of manufacturing the conventional wireless communication device. Furthermore, because the antenna 406 of the embodiment has a larger design area, a better radiation environment and can be easily designed as an antenna with different polarizations, the antenna 406 of the embodiment has higher efficiency in comparison with the conventional antenna.

Please be noticed that the frame boards 208, 308 of the electronic modules 200, 300 in FIGS. 2 and 3 can be replaced by a plurality of solder balls (similar to the electronic module 400 in FIG. 4).

According to the above embodiments, it is understood that in addition to the advantage of smaller area, the molding process can be omitted when manufacturing the electronic module. Therefore, the embodiments of the present disclosure can drastically reduce the cost of manufacturing the electronic module. In addition, since the antenna of the present disclosure can be disposed on the surfaces in different directions, it is easier to design antennas with different polarizations. Furthermore, the antenna of the present disclosure has a larger design area and a better radiation environment. Therefore, the antenna of the present disclosure provides a better performance on throughput in comparison with the conventional antenna.

The technical features of the present disclosure are disclosed above. However, it can be clearly understood by those skilled in the art that various changes may be made, and equivalent elements may be substituted within the embodiments without departing from the true spirit and scope of the present disclosure as defined by the appended claims. For example, the above-mentioned process can be replaced by other processes.

In addition, the scope of the claims cannot be limited by the processes, materials, devices, methods or steps stated above. It can be clearly understood by those skilled in the art that various changes may be made, and equivalent elements may be substituted within the embodiments without departing from the true spirit and scope of the present disclosure as defined by the appended claims. The following claims encompass the processes, materials, devices, methods or steps of the present disclosure.

What is claimed is:

1. An electronic module, comprising:
an integrated circuit (IC);
a substrate having a top surface, a bottom surface and a lateral surface, the IC electrically connected to the bottom surface;
an antenna disposed on at least two of the top surface, the bottom surface and the lateral surface;
a frame board disposed on the bottom surface for electrically connecting the IC and the substrate to a circuit board;
a grounding layer within the substrate; and
a grounding plane within the frame board and electrically connected to the grounding layer.

2. The electronic module according to claim 1, wherein the antenna is disposed on the top surface and the lateral surface.

3. The electronic module according to claim 1, wherein the antenna is disposed on the top surface and the bottom surface.

4. The electronic module according to claim 1, wherein the antenna is disposed on the top surface, the bottom surface and the lateral surface.

5. The electronic module according to claim 1, wherein an exterior surface of the frame board and the lateral surface of the substrate substantially form a plane, and the antenna is disposed on the top surface and the plane.

6. The electronic module according to claim 1, wherein an exterior surface of the frame board and the lateral surface of the substrate are not coplanar, and the antenna is disposed on the top surface, the lateral surface and the bottom surface.

7. An electronic module, comprising:
an integrated circuit (IC);
a substrate having a top surface, a bottom surface and a lateral surface, the IC electrically connected to the bottom surface;
a first antenna array disposed on the top surface;
a second antenna array disposed on the lateral surface;
a third antenna array disposed on the bottom surface;
a frame board disposed on the bottom surface for electrically connecting the IC and the substrate to a circuit board;
a grounding layer within the substrate; and
a grounding plane within the frame board and electrically connected to the grounding layer.

8. The electronic module according to claim 7, wherein the first antenna array on the top surface, the second antenna array on the lateral surface and the third antenna array on the bottom surface are individual antenna arrays.

9. The electronic module according to claim 7, wherein the first antenna array on the top surface, the second antenna array on the lateral surface and the third antenna array on the bottom surface are connected to each other to form an antenna array.

10. The electronic module according to claim 7, wherein the first antenna array, the second antenna array and the third antenna array are configured to transmit and receive signal in a first frequency band in case that the first antenna array on the top surface, the second antenna array on the lateral surface and the third antenna array on the bottom surface are individual antenna arrays.

11. The electronic module according to claim 10, wherein the first antenna array, the second antenna array and the third antenna array are configured to transmit and receive signal in a second frequency band in case that the first antenna array on the top surface, the second antenna array on the lateral surface and the third antenna array on the bottom surface are connected to each other to form an antenna array.

12. The electronic module according to claim 11, wherein the first frequency band is higher than the second frequency band.

13. An electronic module, comprising:
an integrated circuit (IC);
a substrate having a top surface, a bottom surface and a lateral surface, the IC electrically connected to the bottom surface;
an antenna disposed on at least two of the top surface, the bottom surface and the lateral surface;
a frame board disposed on the bottom surface for electrically connecting the substrate to a circuit board; and
a grounding plane within the frame board and connected to the substrate to provide grounding for the substrate.

14. The electronic module according to claim 13, wherein an exterior surface of the frame board and the lateral surface of the substrate substantially form a plane, and the antenna is disposed on the top surface and the plane.

15. The electronic module according to claim 13, wherein an exterior surface of the frame board and the lateral surface of the substrate are not coplanar, and the antenna is disposed on the top surface, the lateral surface and the bottom surface.

16. The electronic module according to claim 13, further comprising:

a grounding layer disposed on the substrate.

17. The electronic module according to claim 16, wherein the grounding plane is electrically connected to the grounding layer.

* * * * *